US007631864B1

(12) United States Patent
Howe et al.

(10) Patent No.: US 7,631,864 B1
(45) Date of Patent: Dec. 15, 2009

(54) CATCH TRAY FOR DOCUMENT PRODUCTION DEVICE

(75) Inventors: Alexandria J. Howe, Hertforshire (GB); James Wood, London (GB); Stephen Paul Wood, Beds (GB)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/337,079

(22) Filed: Dec. 17, 2008

(51) Int. Cl.
*B65H 31/00* (2006.01)

(52) U.S. Cl. ..... 271/207; 271/209

(58) Field of Classification Search ..... 271/145, 271/207, 209; 399/405
See application file for complete search history.

(56) References Cited

U.S. PATENT DOCUMENTS 6,027,269 A * 2/2000 Yoshida ..... 400/625
6,065,747 A * 5/2000 Khovaylo et al. ..... 271/209
6,714,326 B1 * 3/2004 Yamada ..... 358/498
7,152,972 B2 * 12/2006 King et al. ..... 347/104
7,367,559 B2 5/2008 Motamed
2007/0110469 A1 * 5/2007 Kasai ..... 399/93
2008/0067737 A1 * 3/2008 Kosuda et al. ..... 271/207
2008/0205952 A1 * 8/2008 Murai ..... 399/367

* cited by examiner

*Primary Examiner*—David H Bollinger
(74) *Attorney, Agent, or Firm*—Pepper Hamilton LLP

(57) ABSTRACT

In an embodiment, a catch tray may include a first end configured to connect to a document production resource, a second end and a top surface having a plurality of ribs. A rib may have a first end and a second end. At least one rib may extend from the first end of the catch tray toward the second end of the catch tray. The height of the rib at the first end of the rib may be larger than the height of the rib at the second end of the rib. The rib may include a first curved side portion, a second curved side portion, and a top portion connected to the first curved side portion and the second curved side portion.

19 Claims, 6 Drawing Sheets

CATCH TRAY FOR DOCUMENT PRODUCTION DEVICE

BACKGROUND

Conventional catch trays receive output from a document production resource such as a printer, copier, scanner and/or the like. Typically, catch trays have ribs that help reduce static between the processed media and the catch tray. In addition, the ribs elevate the processed media, thus making it easier to retrieve the media from the catch tray. Commonly, the ribs are triangular in shape and have a pointed tip onto which the processed media is received.

Conventional catch trays can receive processed media sheets image side down. For such trays, the ribs often scrape and otherwise damage the media images. In addition, a large stack of processed media applies significant pressure to the media sheet on the bottom of the stack which can also cause damage to the media images.

SUMMARY

Before the present methods are described, it is to be understood that this invention is not limited to the particular systems, methodologies or protocols described, as these may vary. It is also to be understood that the terminology used herein is for the purpose of describing particular embodiments only, and is not intended to limit the scope of the present disclosure which will be limited only by the appended claims.

It must be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art. As used herein, the term "comprising" means "including, but not limited to."

In an embodiment, a catch tray may include a first end configured to connect to a document production resource, a second end and a top surface having a plurality of ribs. A rib may have a first end and a second end. At least one rib may extend from the first end of the catch tray toward the second end of the catch tray. The height of the rib at the first end of the rib may be larger than the height of the rib at the second end of the rib. The rib may include a first curved side portion, a second curved side portion, and a top portion connected to the first curved side portion and the second curved side portion.

In an embodiment, a device for processing print jobs may include a feeder, a tray base configured to interconnect with the feeder and a catch tray configured to interconnect with the tray base. The catch tray may include a first end, a second end and a top surface having a plurality of ribs. At least one rib may extend from the first end of the catch tray toward the second end of the catch tray, and the rib may have a first end and a second end. The height of the rib at the first end of the rib may be larger than the height of the rib at the second end of the rib. The rib may include a first curved side portion, a second curved side portion and a top portion connected to the first curved side portion and the second curved side portion.

BRIEF DESCRIPTION OF THE DRAWINGS

Aspects, features, benefits and advantages of the present invention will be apparent with regard to the following description and accompanying drawings, of which.

DETAILED DESCRIPTION

For purposes of the discussion below, a "document production resource" refers to a printer, a copier, a multifunction machine or system, a xerographic machine or system, or any other type of reproduction apparatus that is capable of printing images on at least a portion of a sheet.

A "sheet" refers to a physical sheet of paper, plastic and/or other suitable substrate for printing images thereon.

A "catch tray" refers to a tray that receives processed media from a document production resource.

A "rib" refers to a protrusion or ridge on a catch tray.

A "job" refers to a logical unit of work that is to be completed for a customer. A job may include one or more print jobs from one or more clients. A production system may include a plurality of jobs.

A "print job" refers to a job processed in a document production system.

Figure 1:
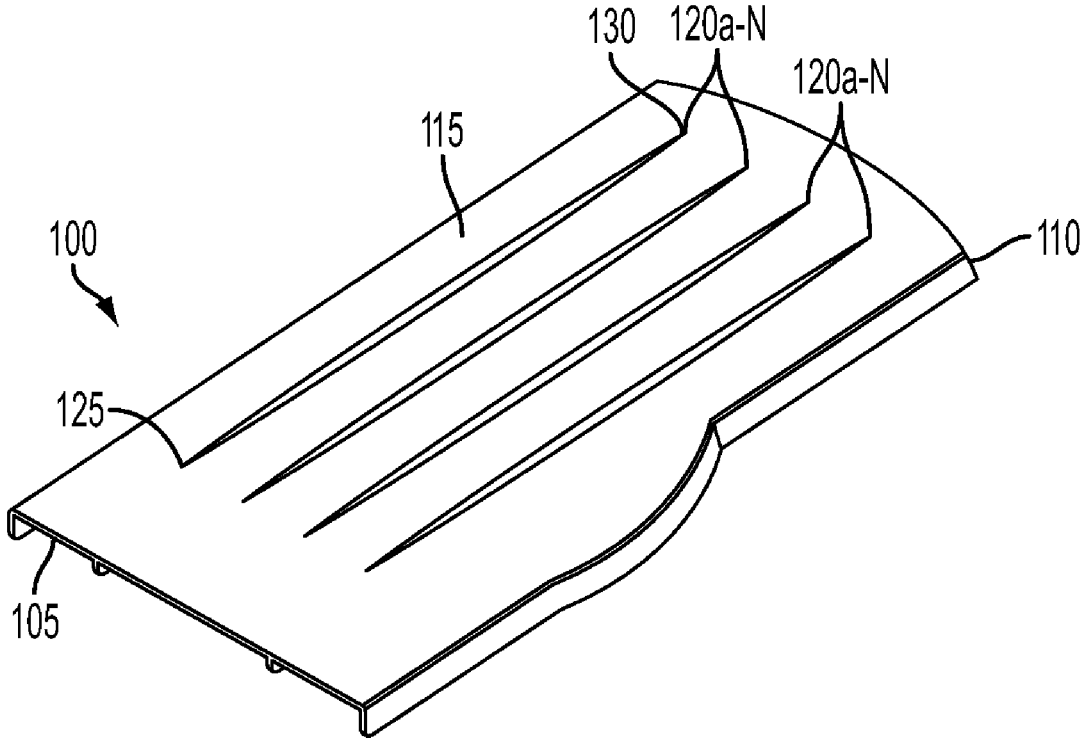
FIG. 1 illustrates an exemplary catch tray according to an embodiment.
Figure 2:
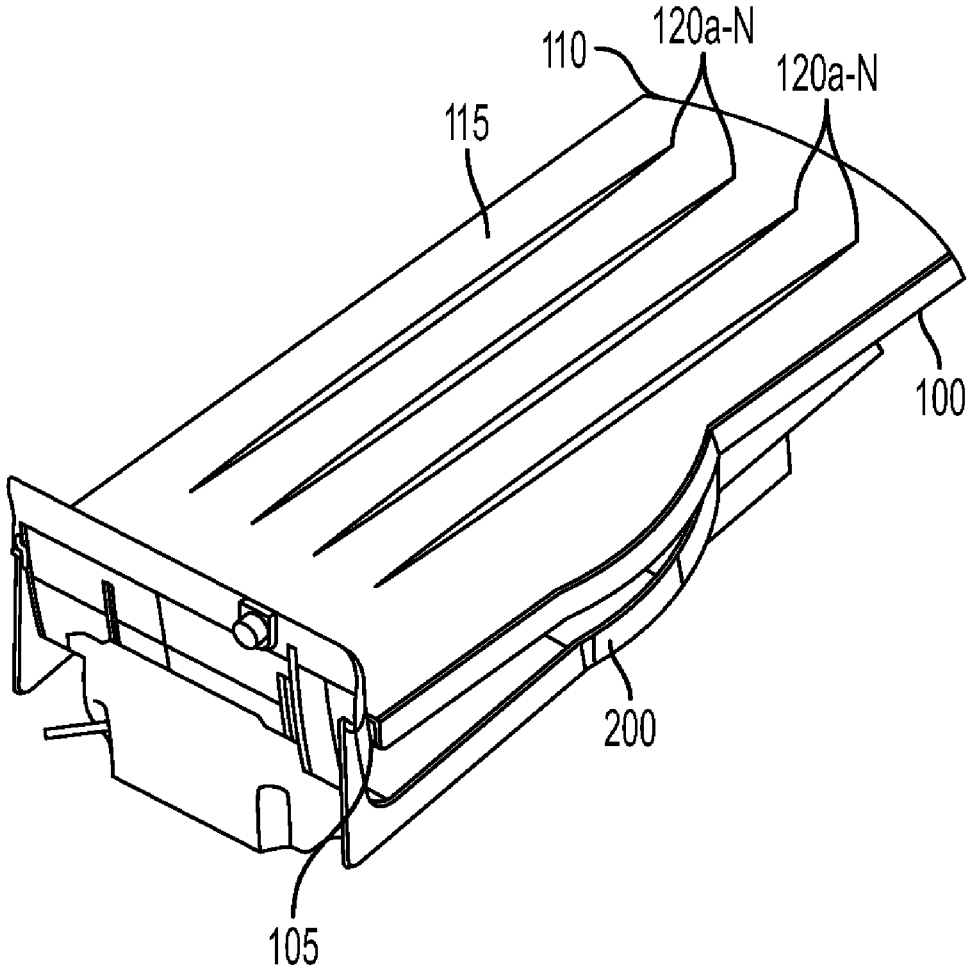
FIG. 2 illustrates an exemplary catch tray according to an embodiment.
Figure 3:
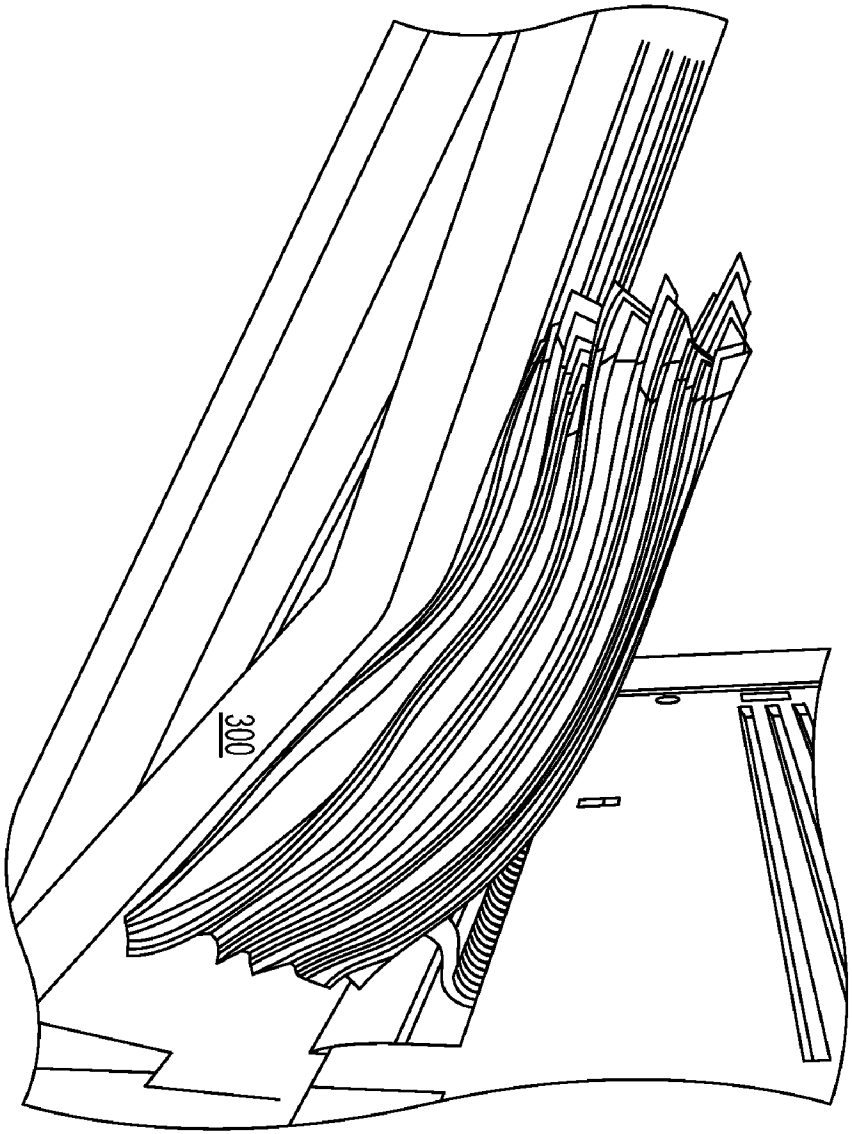
FIG. 3 illustrates an exemplary document production resource having an broken-back tray base according to an embodiment.

FIG. 1 illustrates an exemplary catch tray according to an embodiment. As illustrated by FIG. 1, a catch tray 100 may have a first end 105 and a second end 110. The first end 105 may be connected to a document production resource. In an embodiment, the catch tray 100 may be integrally formed with the document production resource. Alternatively, the catch tray 100 may be removeably connected to the document production resource. In an embodiment, the catch tray 100 may be fitted over an existing tray base 200 as illustrated by FIG. 2. For example, the catch tray 100 may be fitted to a document production resource having a broken back tray base configuration. FIG. 3 illustrates an exemplary document production resource having a broken-back tray base according to an embodiment. As illustrated by FIG. 3, a broken-back tray base 300 may have an inverted "V" shape. This configuration may facilitate the movement and stacking of downwardly-curled paper.

In an embodiment, the catch tray 100 may be an offset catch tray. In an embodiment, the catch tray 100 may receive multiple print jobs that are offset from each other in order to distinguish the print jobs. For example, the position of one print job on the catch tray 100 may be offset from the position of another print job on the catch tray so a user may discern where one print job ends and another begins.

In an alternate embodiment, the catch tray 100 may be a static catch tray. A static catch tray may receive print jobs without any offset between them.

In an embodiment, the catch tray 100 may receive media from the document production resource once the media has been processed. The second end 110 of the catch tray 100 may extend outwardly from the document production resource as illustrated by FIG. 1. In an embodiment, the second end 110 of the catch tray 100 may be angled upwardly relative to the first end 105 of the catch tray. The catch tray 100 may include a top surface 115 that may extend from the first end 105 of the catch tray to the second end 110 of the catch tray.

In an embodiment, the top surface 115 of the catch tray 100 may have a plurality of ribs 120*a*-N. For example, as illustrated by FIG. 1, a catch tray 100 may have four ribs 120*a*-N spaced substantially equally across the tray. For example, each rib 120*a*-N may be located approximately 65 millimeters apart from another rib. More, fewer, alternate and additional ribs may be used within the scope of this disclosure. Additional and/or alternate spacing between the ribs may be used within the scope of this disclosure.

In an embodiment, a rib 120*a*-N may be positioned such that it does not catch the edge of one or more sheets. For example, a rib 120*a*-N may be positioned on a catch tray 100 such that it does not catch the edge of an 8.5×11-sized sheet, an A4 LEF sheet, an A4 SEF sheet and/or the like.

In an embodiment, a rib 120*a*-N may extend from the first end 105 of the catch tray 100 toward the second end 110 of the catch tray. In an embodiment, a first end 125 of a rib 120*a*-N may be located a distance from the first end 105 of the catch tray 100 and a second end 130 of the rib 120*a*-N may be located a distance from the second end 110 of the catch tray. For example, the first end 125 of a rib 120*a*-N may be located approximately 65 millimeters from the first end 105 of the catch tray 100, while the second end 130 of the rib 120*a*-N may be located approximately 29-31 millimeters from the second end 110 of the catch tray. A rib 120*a*-N may be located at additional and/or alternate distances from the first end 105 and/or the second end 110 of the catch tray 100 within the scope of this disclosure.

In an embodiment, the length of a rib 120*a*-N may be between approximately 289.0 millimeters and 295.0 millimeters. Additional and/or alternate rib lengths may be used within the scope of this disclosure.

In an embodiment, one or more ribs 120*a*-N may be a different length than one or more other ribs. For example, if a catch tray 100 has four ribs 120*a*-N, the middle two ribs may be one length, while the outer two ribs may be another length.

In an embodiment, a rib 120*a*-N may be integrally formed with the top surface 115 of the catch tray 100. The ribs 120*a*-N may be raised relative to the top surface 115 of the catch tray 100. In an embodiment, the ribs 120*a*-N may be fabricated from plastic, metal and/or any other suitable material.

Figure 4:
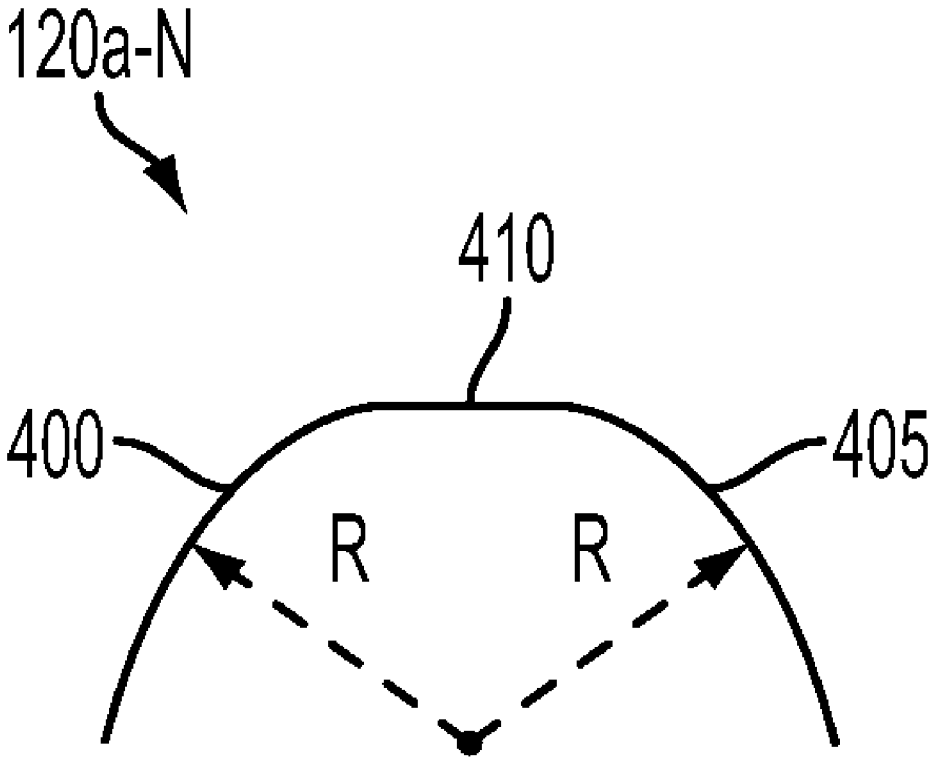
FIG. 4 illustrates a cross-section of a rib according to an embodiment.

FIG. 4 illustrates a cross-section of a rib 120*a*-N according to an embodiment. As illustrated, a rib 120*a*-N may have two side portions 400, 405, each of which may have a curved configuration. In an embodiment, each side portion 400, 405 may have an upwardly curved configuration. For example, as illustrated by FIG. 4, one side portion 400 may curve upwardly and toward the right, while the other side portion 405 may curve upwardly and toward the left. In an embodiment, each side portion 400, 405 may have approximately equal radii. For example, each side portion 400, 405 may have approximately a 2 millimeter radius. In an alternate embodiment, the ribs 120*a*-N may be raised, with a straight portion topped by an upwardly curved portion.

As illustrated by FIG. 4, a rib 120*a*-N may have a top portion 410. The top portion 410 may connect the first side portion 400 to the second side portion 405. In an embodiment, the top portion 410 may be substantially flat. The top portion 410 may have a length of approximately 2 millimeters.

Figure 5:
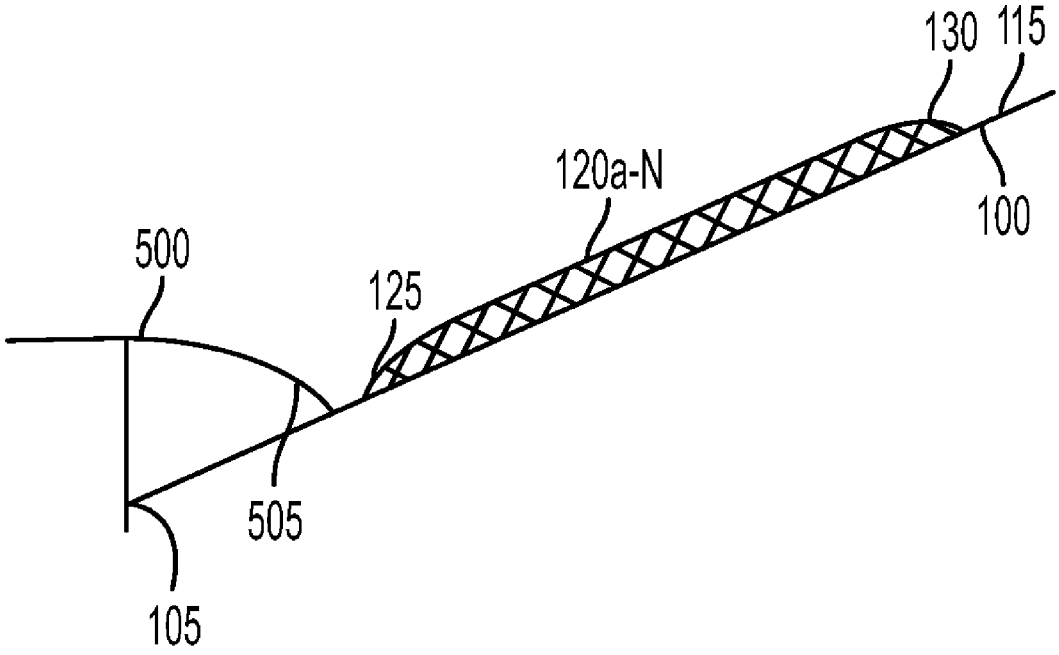
FIG. 5 illustrates a side view of an exemplary catch tray having graduated ribs according to an embodiment.
Figure 6:
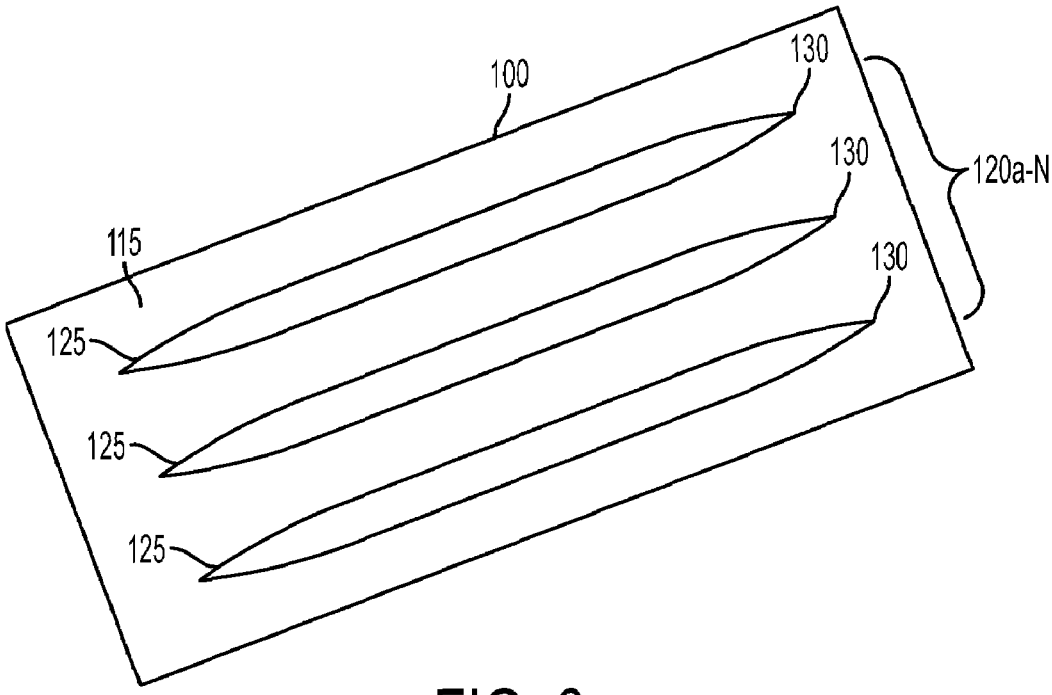
FIG. 6 illustrates a top view of an exemplary catch tray having graduated ribs according to an embodiment.

In an embodiment, the height of a rib 120*a*-N may be graduated in the direction that the media is received. FIG. 5 illustrates a side view of an exemplary catch tray having graduated ribs according to an embodiment. FIG. 6 illustrates a top view of an exemplary catch tray having graduated ribs according to an embodiment. As illustrated by FIGS. 5 and 6, a first end 125 of a rib 120*a*-N may be located on the top surface 115 of the catch tray 100 slightly ahead of where the lead edge 505 of a media sheet 500 is received by the tray. For example, a first end 125 of a rib 120*a*-N may be located approximately 50 millimeters from the first end 105 of the catch tray 100. Additional and/or alternate distances may be used within the scope of this disclosure.

In an embodiment, the height of the rib 120*a*-N may gradually increase toward a second end 130 of the rib 120*a*-N. For example, the height of the rib 120*a*-N at the second end 130 may be larger than the height of the rib at the first end 125. In an embodiment, graduated ribs may help minimize image marking on processed media.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A catch tray comprising:

a first end configured to connect to a document production resource:

a second end; and a top surface comprising a plurality of ribs, wherein at least one rib extends from the first end of the catch tray toward the second end of the catch tray, wherein the rib has a first end and a second end, wherein a height of the rib at the first end of the rib is larger than a height of the rib at the second end of the rib, wherein the rib comprises:

a first curved side portion, a second curved side portion, and a top portion connected to the first curved side portion and the second curved side portion.

2. The catch tray of claim 1, wherein a radius of the first curved side portion is substantially equal to a radius of the second curved side portion.

3. The catch tray of claim 1, wherein one or more of the first curved side portion and the second curved side portion has a radius of approximately 2 millimeters.

4. The catch tray of claim 3, wherein a length of the top portion is approximately 2 millimeters.

5. The catch tray of claim 1, wherein a height of the rib gradually decreases from the first end of the rib to the second end of the rib.

6. The catch tray of claim 1, wherein the rib is integrally formed with the top surface.

7. The catch tray of claim 1, wherein the catch tray is configured to interconnect with a tray base of a document production resource.

8. The catch tray of claim 1, wherein the catch tray is an offset catch tray.

9. The catch tray of claim 1, wherein the first end of the rib is located approximately 29 to 31 millimeters from the first end of the catch tray.

10. The catch tray of claim 1, wherein the second end of the rib is located approximately 65 millimeters from the second end of the catch tray.

11. A device for processing print jobs, the device comprising:

a feeder;

a tray base configured to interconnect with the feeder; and a catch tray configured to interconnect with the tray base, wherein the catch tray comprises:

a first end, a second end, and a top surface comprising a plurality of ribs, wherein at least one rib extends from the first end of the catch tray toward the second end of the catch tray, wherein the rib has a first end and a second end, wherein a height of the rib at the first end of the rib is larger than a height of the rib at the second end of the rib, wherein the rib comprises:

a first curved side portion, a second curved side portion, and a top portion connected to the first curved side portion and the second curved side portion.

12. The device of claim 11, wherein a radius of the first curved side portion is substantially equal to a radius of the second curved side portion.

13. The device of claim 11, wherein one or more of the first curved side portion and the second curved side portion has a radius of approximately 2 millimeters.

14. The device of claim 13, wherein a length of the top portion is approximately 2 millimeters.

15. The device of claim 11, wherein a height of the rib gradually decreases from the first end of the rib to the second end of the rib.

16. The device of claim 11, wherein the rib is integrally formed with the top surface.

17. The catch tray of claim 11, wherein the catch tray is an offset catch tray.

18. The catch tray of claim 11, wherein the first end of the rib is located approximately 29 to 31 millimeters from the first end of the catch tray.

19. The catch tray of claim 11, wherein the second end of the rib is located approximately 65 millimeters from the second end of the catch tray.

* * * * *